US006629666B2

(12) United States Patent
Lee et al.

(10) Patent No.: US 6,629,666 B2
(45) Date of Patent: Oct. 7, 2003

(54) APPARATUS OF A PRINTER FOR DETECTING TERMINATION OF PRINTING MEDIUM

(75) Inventors: Hong-gil Lee, Suwon (KR); Jung-yong Lee, Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/901,561

(22) Filed: Jul. 11, 2001

(65) Prior Publication Data

US 2002/0023983 A1 Feb. 28, 2002

(30) Foreign Application Priority Data

Jul. 11, 2000 (KR) ..... 2000-39708
Sep. 21, 2000 (KR) ..... 2000-55404

(51) Int. Cl.[7] ..... B65H 26/08; B65H 16/02
(52) U.S. Cl. ..... 242/563; 242/591; 242/595
(58) Field of Search ..... 242/563–563.2, 242/591, 595; 83/649, 949; 250/559.24, 559.27

(56) References Cited

U.S. PATENT DOCUMENTS 1,988,255 A * 1/1935 Soons ..... 242/563
5,607,121 A * 3/1997 Boriani et al. ..... 242/563.2
5,713,678 A * 2/1998 Smith et al. ..... 242/563
5,758,982 A * 6/1998 Yoshida et al. ..... 242/563
5,820,068 A * 10/1998 Hosomi et al. ..... 242/563
5,884,861 A * 3/1999 Hosomi et al. ..... 242/563
6,135,384 A * 10/2000 Skelly et al. ..... 242/563

FOREIGN PATENT DOCUMENTS

EP 1 063 189 A2 12/2000

OTHER PUBLICATIONS

IBM Technical Disclosure Bulletin (vol. 37, No. 5, May 1994, pp. 195–196.

* cited by examiner

*Primary Examiner*—John M. Jillions
(74) *Attorney, Agent, or Firm*—Sughrue Mion, PLLC

(57) ABSTRACT

An apparatus of a printer for detecting a termination or near-termination of a printing medium includes a frame for housing and supporting a roll of the printing medium and capable of being set in a first position and a second position; a first printing medium detecting portion and a second printing medium detecting portion for non-contact detection of the termination or near-termination of the printing medium according to a varying diameter of the roll of the printing medium when the frame is in the first position and the second position; and a position adjusting portion for adjusting an initial set position of the first and the second printing medium detecting means according to an initial diameter of the roll of the printing medium.

18 Claims, 8 Drawing Sheets

APPARATUS OF A PRINTER FOR DETECTING TERMINATION OF PRINTING MEDIUM

BACKGROUND OF THE INVENTION

1. Field of the Invention

The present invention relates to a printer and, more particularly, to an apparatus of a label printer for detecting a termination of a web of printing medium that is continuously fed from a supply reel and severed into a label unit.

2. Description of the Related Art

Generally, a label printer, also called a mini-printer, prints out indicia on a sheet of printing medium such as stickers, receipts, etc., which are severed from a continuous web of printing medium reeled around a cylindrical core. For example, label printers are used in cash registers, or to print out numbers for customers waiting in line at a bank, etc. Such label printers employ detecting devices for detecting a termination of the printing medium.

FIGS. 1A and 1B show one example of a device for detecting the termination of the printing medium of the conventional printer, which is disclosed in detail in U.S. Pat. No. 5,884,861.

Referring to FIGS. 1A and 1B, the detecting device includes a frame 10 to which a web of printing medium reeled around a cylindrical core 2 is mounted for being fed by a predetermined unit label, and a level member 20 mounted on a side of the frame 10 to be pivoted towards and away from the frame 10.

The lever member 20 includes a first detecting protrusion 21 and a second detecting protrusion 22 protruding toward the frame 10, and a switch contacting protrusion 23 protruding oppositely from the first and the second detecting protrusions 21 and 22. The first and the second detecting protrusions 21 and 22 and the switch contacting protrusion 23 are vertically spaced from each other at a predetermined distance.

The first and the second detecting protrusions 21 and 22 enter or exit to or from the frame 10 through an opening (not shown) formed on the frame 10. Here, the reference numeral 30 refers to a limit switch for outputting a predetermined signal to a main controller (not shown) by a complementary operation with the switch contacting protrusion 23 during the pivoting movement of the lever member 20.

Meanwhile, the frame 10 has a guiding portion (not shown) that is stepped on an inner surface of the frame 10, for guiding the web of printing medium 1 therealong as the printing medium is near its termination.

That is, in an initial state, since the web of printing medium 1 is large in diameter, the first detecting protrusion 21 of the lever member 20 is interrupted by one end of the web of the printing medium 1 (see FIG. 1A), thereby restricting the pivoting movement of the lever member 20. As the switch contacting protrusion 23 presses the limit switch 30, a signal indicating an off-state of the limit switch 30 is output to the main controller (not shown) which thereby recognizes a normal state of the printing medium 1, and maintains normal operation of the printer.

Then as the printing medium 1 is continuously supplied and thus near its termination, the diameter of the web of the printing medium 1 is decreased to the state shown in FIG. 1B. In this state, the web of the printing medium 1 descends to a lower portion of the frame 10, and, accordingly, the first detecting protrusion 21 is released from interruption by the web of printing medium 1.

Simultaneously, as the second detecting protrusion 22 is inserted in a hollow portion of the cylindrical core 2, the lever member 20 is freely pivoted closer to the frame 10. In this position, the switch contacting protrusion 23 of the lever member 20 operates the limit switch 30 and generates an electric signal. Accordingly, a near-termination or termination of the printing medium 1 can be detected.

However, since the detecting device for detecting termination of the printing medium 1 of the conventional printer essentially requires a hollow hole in the core 2 that is reeled with the printing medium 1, the detecting device can only be used for a limited number of applications.

Also, when using the web of printing medium 1 which has a core 2 of different length, in order to connect the first and the second detecting protrusions 21 and 22 to the side of the printing medium, a user has to unscrew a screw (not shown) that fastens the frame 10 and the lever member 20, adjust the positions of the first and the second detecting protrusions 21 and 22, as necessitated by the particular core 2 being used, and refasten the screw to re-secure the frame 10 and the lever member 20.

Further, when using the web of printing medium 1 of different diameter, the contacting area of the first and the second detecting protrusions 21 and 22 changes. Consequently, the gap between the first and the second detecting protrusions 21 and 22 must be adjusted, or, alternatively, the lever member 20 must be replaced by a new lever member 20 having the necessary gap between the first and the second detecting protrusions 21 and 22. As a result, the user experiences inconvenience when working with this printer. Further, the accuracy in detecting a near-termination or termination of the printing medium 1 is deteriorated due to frequent adjustments described above.

For the foregoing reasons, when using the conventional detecting device of the printer for detecting termination of the printing medium, it is preferred that printing mediums 1 of different sizes not be used. Rather, it is preferred that limitations be placed on any variation in the size of the printing medium 1 used. Further, the frame 10 of the conventional printer has a shortcoming. It can only be used in a certain fixed posture.

SUMMARY OF THE INVENTION

The present invention has been made to overcome the above-mentioned problems of the related art, and, accordingly, it is an object of the present invention to provide a non-contact detecting device for detecting termination of printing medium in a printer, the device enabling a user to easily adjust an initial set position of a detecting portion to correspond to respective sizes of webs of the printing medium used in the printer.

Another object of the present invention is to provide a detecting device of a printer for detecting a termination of the printing medium having improved detection accuracy, user convenience, and compatibility, which can be variably used in a desktop posture or wall mount posture without having to adjust an initially set posture.

The above objects are accomplished by an apparatus of a printer for detecting a termination of a printing medium in accordance with the present invention, including a frame housing and supporting a roll of the printing medium for allowing supply of the printing medium by a label unit; printing medium detecting means for non-contact detecting of the termination of the printing medium according to varying diameter of the roll of the printing medium; and position adjusting means for adjusting an initial set position of the printing medium detecting means according to an initial diameter of the roll of the printing medium.

Another object of the present invention is accomplished by an apparatus of a printer for detecting a termination of a printing medium in accordance with the present invention, including a frame housing and supporting a roll of the printing medium for allowing supply of the printing medium by a label unit, the frame capable of being set on a first position and a second position; first printing medium detecting means and second printing medium detecting means for non-contact detecting of the termination of the printing medium according to varying diameter of the roll of the printing medium when the frame is on the first position and the second position; and position adjusting means for adjusting an initial set position of the first and the second printing medium detecting means according to an initial diameter of the roll of the printing medium.

According to one aspect of the present invention, the printing medium detecting means includes a window formed on the frame, capable of permitting a light to pass therethrough; a photo sensor module for emitting the light to the window, detecting light reflected from the window, and outputting the result in the form of an electrical signal; and a housing movably mounted on the frame for supporting the photo sensor module.

The housings have an aperture through which the light from the photo sensor modules is passed in a uniform width.

The aperture has a width in the range from 30% to 50% of the diameter of a light spot emitted from the photo sensor modules, and it is preferable that the housings have a shutter member slidably mounted on the aperture for adjusting the width of the aperture.

The position adjusting means includes a cam pin formed on the housing and a rotary knob rotatably mounted on the frame and having a cam groove for linearly reciprocating the housing in cooperation with the cam pin which is locked in the cam groove and moved along the cam groove in a cam fashion.

According to another aspect of the present invention, there is further provided a positioning device to the frame and the rotary knob for locking and unlocking a rotational movement of the rotary knob by a predetermined amount, and determining a moved location of the housing.

The positioning device in accordance with one preferred embodiment of the present invention includes a tab protrusion formed on an elastic rib which is movably formed on the rotary knob; and a plurality of tab grooves formed on the frame in a predetermined pattern, to which the tab protrusion is selectively seated according to the rotational movement of the rotary knob.

According to another aspect of the present invention, the frame has a guiding portion, stepped on an inner surface of the frame, for guiding the roll of the printing medium therealong to a lower portion of the frame as the diameter of the printing medium is decreased below a point at which the printing medium is nearly terminated.

BRIEF DESCRIPTION OF THE DRAWINGS

The above object and other features of the present invention will be clarified by the following description with the attached drawings, in which.

DETAILED DESCRIPTION OF THE PREFERRED EMBODIMENT

This invention will be described in further detail by way of example with reference to the attached drawings. According to the present invention, the compatibility of the detecting device is enhanced since the detecting device can be used in a horizontal plane (hereinafter called the "first posture" or the "first position") for use as a so-called desktop printer, or in a vertical plane (hereinafter called the "second posture" or the "second position") for use as so-called wall mount printer, which are respectively shown in FIGS. 2 and 3, without having to adjust an initially set posture of the detecting device.

Further, according to the detecting device of the printer of the present invention, since the initially set posture of the detecting device can be easily adjusted according to the respective sizes of the printing mediums, the detection accuracy is also enhanced by minutely adjusting detecting points.

Figure 1A:
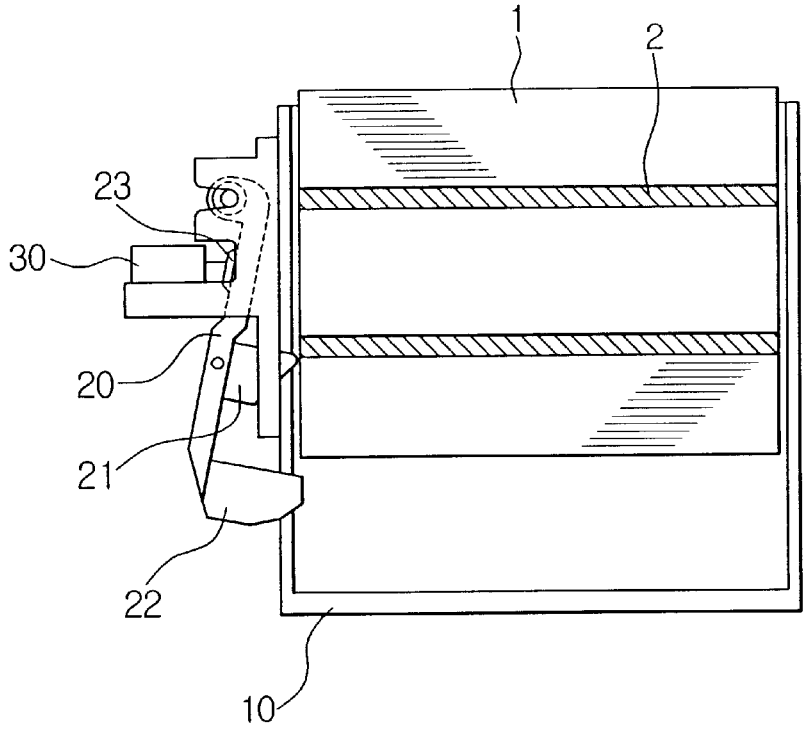
FIG. 1A (PRIOR ART)
FIGS. 1A and 1B are schematic views showing the structure and operation of a conventional device for detecting the termination of a printing medium in a printer.
Figure 1B:
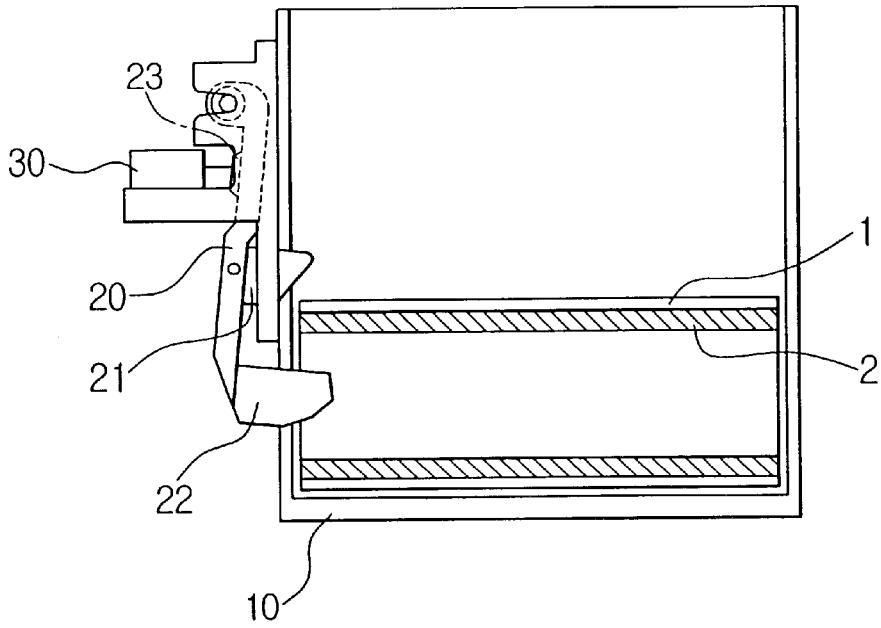
FIG. 1B (PRIOR ART)
Figure 2:
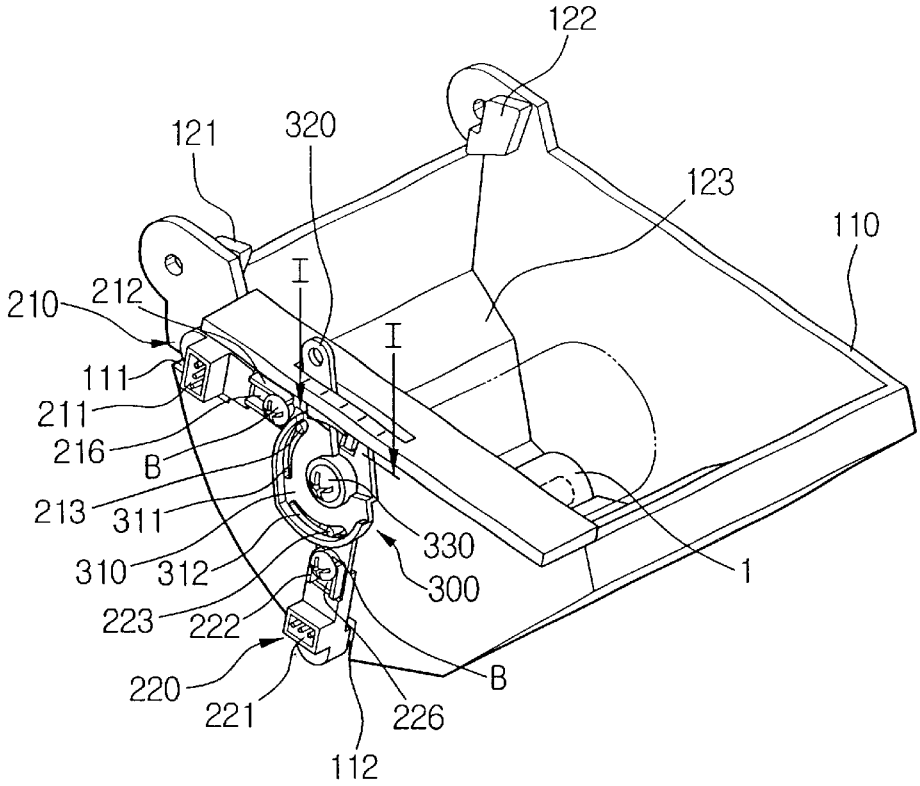
FIGS. 2 and 3 are schematic perspective views showing the detecting device of a printer according to the present invention in respective postures.
Figure 3:
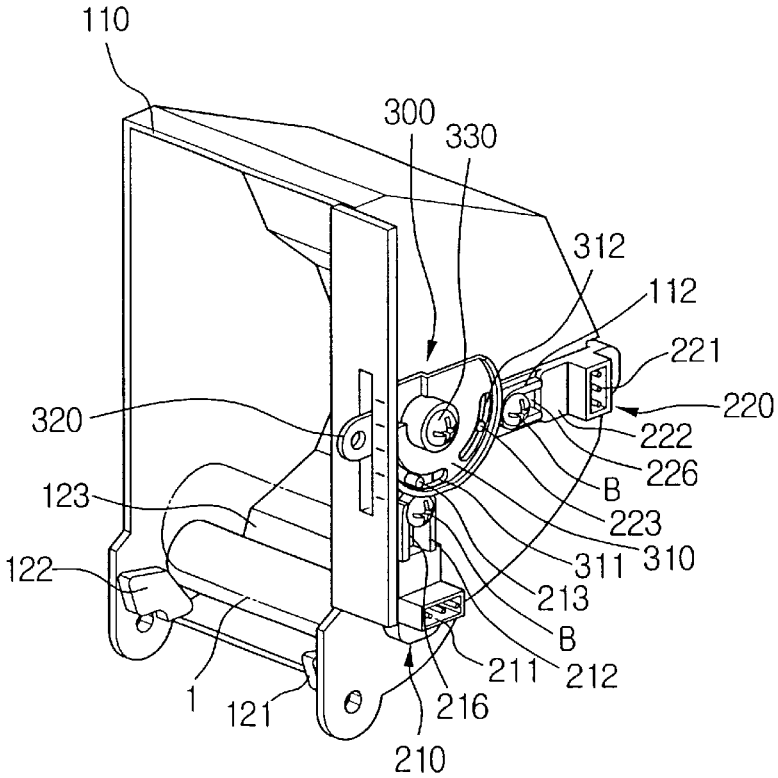

Referring to FIGS. 2 and 3, the detecting device of the printer according to the present invention includes a frame 110 for housing and supporting a roll of printing medium 1 to enable supply of the printing medium by a predetermined label unit. The frame 110 has a first printing medium detecting means 210 and a second printing medium detecting means 220 for non-contact detecting the termination of the printing medium 1 by the diameter of the roll of the printing medium 1.

The initial set position of the first and the second printing medium detecting means 210 and 220 is interactively adjusted by a position adjusting means 300 installed on the frame 110 according to the diameter of the roll of the printing medium 1 during an initial setting of the printing medium 1.

According to the present invention, the frame 110 includes a pair of guiding protrusions 121 and 122 and a stepped guiding end 123 as shown in FIGS. 2 and 3.

The pair of guiding protrusions 121 and 122 and the stepped guiding end 123 serve as the guiding means for gradually guiding the roll of the printing medium 1 downward which is set on the first or the second posture, as the diameter of the roll of the printing medium 1 is decreased by the continuous supply of the printing medium 1.

More specifically, when the frame 110 is in the first posture (see FIG. 9A), the roll of the printing medium 1, of which diameter is decreased to the maximum extent, descends to the lowest portion of the frame 110 along the guiding end 123.

Further, when the frame 110 is in the second posture (see FIG. 9B), the roll of the printing medium 1, of which the diameter is decreased to the maximum extent, descends to the lowest end of the frame 110 by the guiding protrusions 121 and 122 and along the guiding end 123.

The first and the second printing medium detecting means 210 and 220 include a pair of windows 111 and 112 formed on the frame 110 for transmitting light, a pair of photo sensor modules 211 and 221 for outputting electrical signals by emitting light to the windows 111 and 112 and detecting light reflected from the windows 111 and 112, and a pair of housings 212 and 222 formed on the frame 110 for movably supporting the photo sensor modules 211 and 221 and having an aperture 217 (see FIGS. 4A and 4B) through which light from the photo sensor modules 211 and 221 is passed into a limited width W.

Further, the first and the second printing medium detecting means 210 and 220 are arranged on a plane and spaced from each other at a predetermined angle.

According to the arrangement of the first and the second printing medium detecting means 210 and 220, the termination of the printing medium 1 can be detected according to the changing diameter of the roll of the printing medium, whether the frame 110 is positioned in the first position or the second position.

Figure 4A:
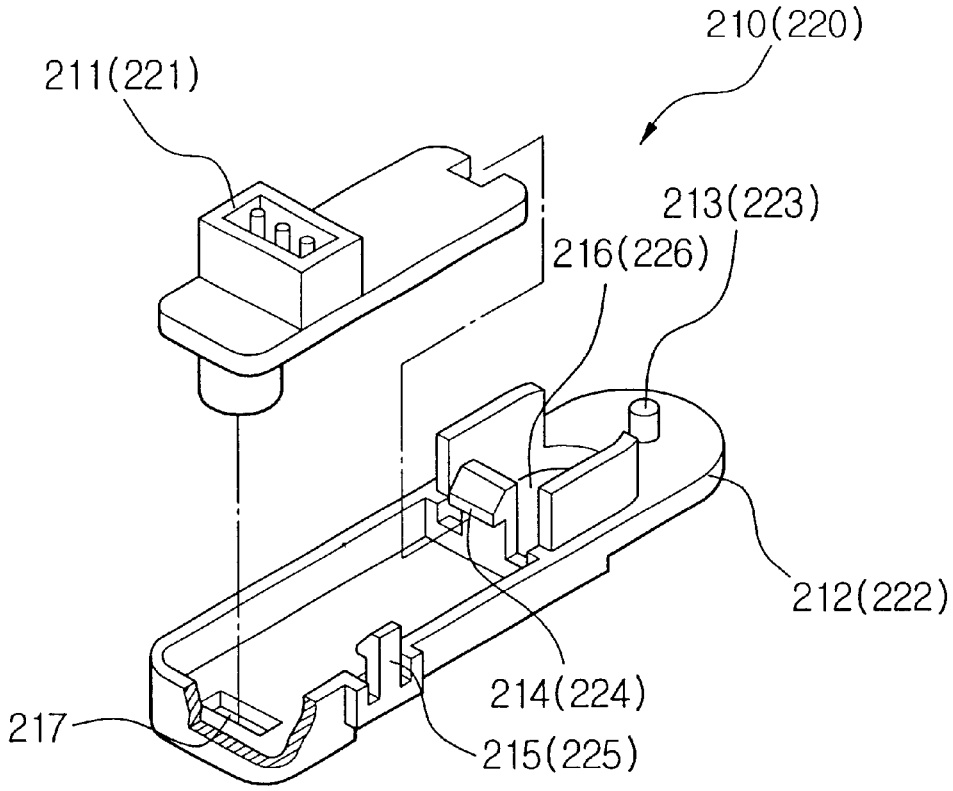
FIGS. 4A and 4B are a schematic perspective view and a plane view, respectively, showing the main portion of the detecting device of the printer according to the present invention.
Figure 4B:
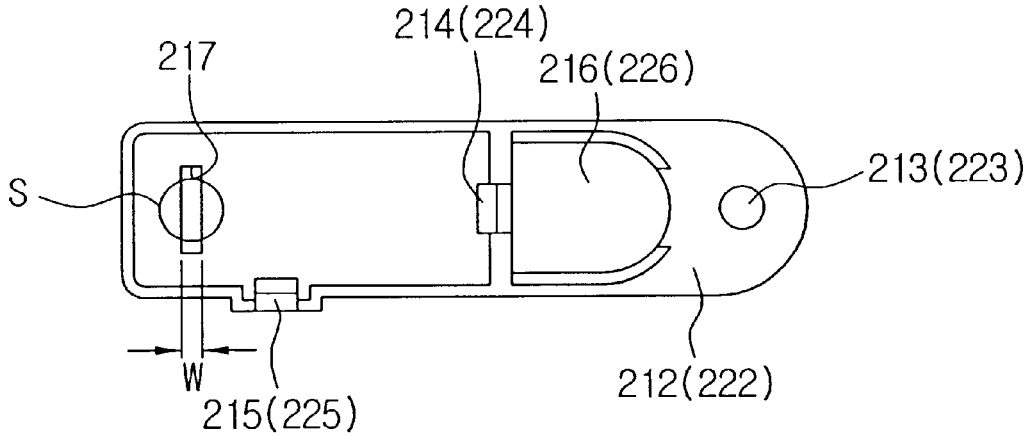

Referring to FIGS. 4A and 4B, the photo sensor modules 211 and 221 are removably mounted on the housings 212 and 222 by hooks 214, 215, 224, 225 formed on the housings 212 and 222, respectively.

The housings 212 and 222 also have long holes 216 and 226 formed thereon. Accordingly, when bosses B (see FIGS. 2 and 3) formed on the frame 110 are inserted in the long holes 216 and 226 of the housings 212 and 222, the housings 212 and 222 are linearly movable in a gap defined by the long holes 216 and 226.

The aperture 217 aids in detecting the printing medium 1 of a predetermined diameter by decreasing a detect angle of the photo sensor modules 211 and 221. The width W of the aperture 217 is preferably in a range from 30 to 50% of the diameter of a beam spot S. The beam spot S is emitted from the photo sensor modules 211 and 221.

For example, if the outer diameter of the beam spot S of light emitting diodes L1 and L2 (see FIG. 10) embedded in the photo sensor modules 211 and 221 is approximately 4 mm, it is preferable that the width W of the aperture 217 be in a range from 1.2 mm to 2.0 mm, perhaps 1.5 mm. This is, however, not strictly limited. Accordingly, the width W of the aperture 217 can be adjusted according to the outer diameter of the beam spot S, performance, or assembly deviations.

Figure 5A:
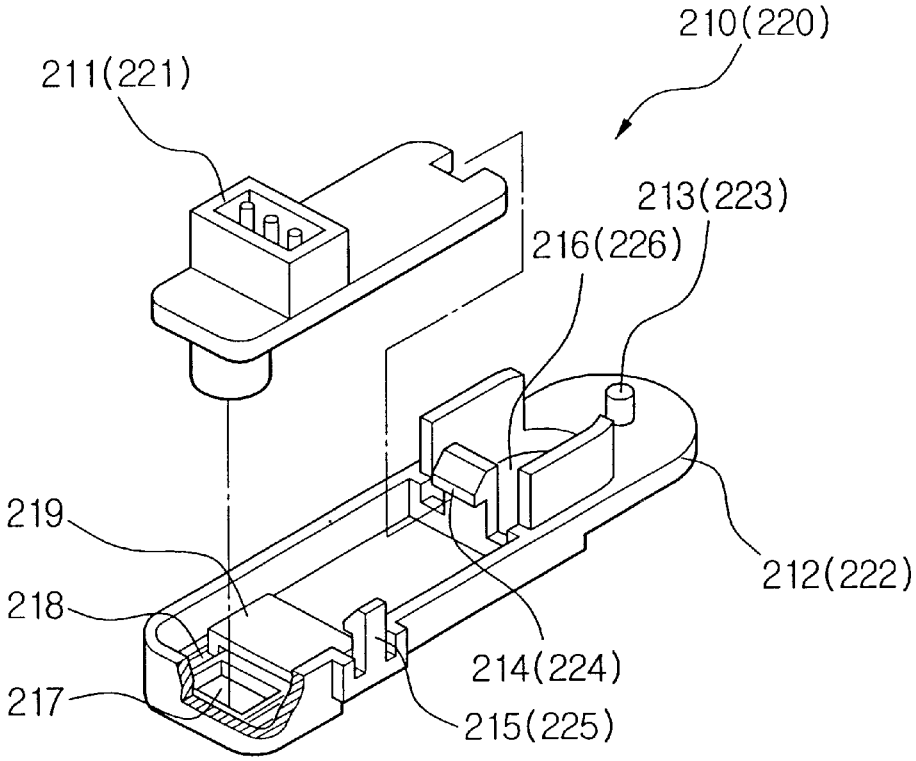
FIGS. 5A and 5B are a schematic perspective view and a plan view, respectively, showing the main portion of the detecting device of the printer according to another preferred embodiment of the present invention.
Figure 5B:
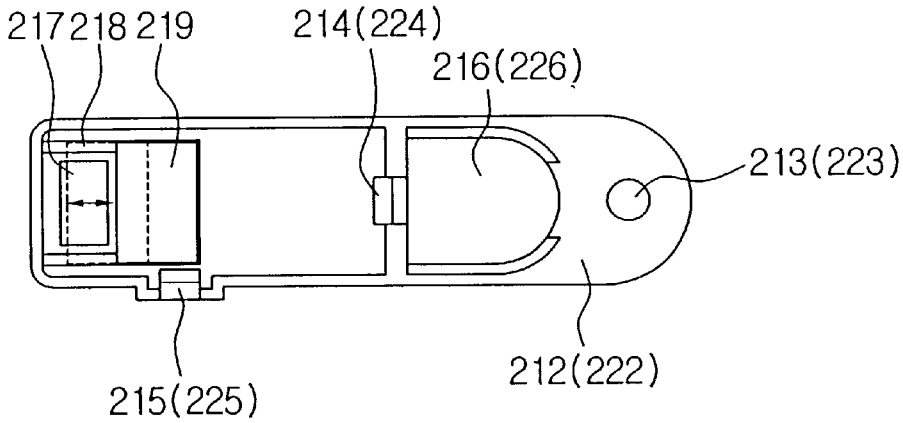

FIGS. 5A and 5B show the detecting device according to another preferred embodiment of the present invention, in which sliding grooves 218 are formed on the housings 212 and 222, and a shutter member 219 is mounted on the sliding grooves 218 for temporarily opening or closing the open portion of the aperture 217. As the shutter member 219 opens or closes the aperture 217, the size of the light spot S can be adjusted.

The position adjusting means 300 includes cam pins 213 and 223 formed on the housings 212 and 222, respectively. The cam pins 213 and 223 linearly reciprocate the housings 212 and 222 by constraining the housings 212 and 222. Referring again to FIGS. 2 and 3, the position adjusting means 300 also includes a rotary knob 310 rotatably formed on a rotary shaft 330 of the frame 110, and having a first cam groove 311 and a second cam groove 312 for linearly reciprocating the housings 212 and 222 by defining channels to which cam pins 213 and 223 are constrained. The range of motion to which the linearly reciprocated housings 212 and 222 are thus confined is referred to herein as cam following.

Figure 6A:
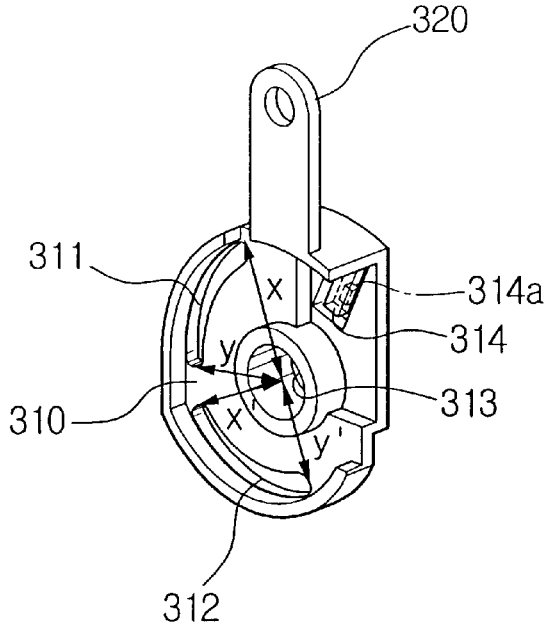
FIGS. 6A and 6B are a schematic perspective view and a plan view, respectively, for explaining the structure and operation of the main portion of the detecting device of the printer according to the present invention.
Figure 6B:
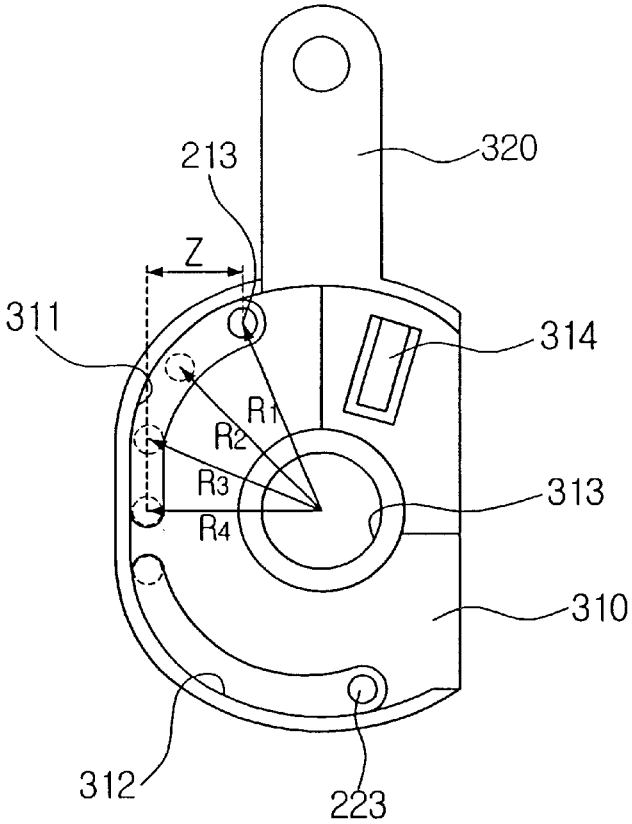

Referring to FIGS. 6A and 6B, the rotary knob 310 has a body with a side, and includes a driving lever 320 extending from the side of the body to serve as a handle for effecting a rotating movement of the rotary knob 310. As shown in FIGS. 2 and 3, the rotary knob 310 is connected to the rotary shaft 330 that is formed on the frame 110. The rotary shaft 330 passes through a center hole 313 defined within the body of the rotary knob 310.

According to the present invention, a distance x between the upper portion of the first cam groove 311 and the center of the center hole 313 should be longer than a distance y between the lower portion of the first cam groove 311 and the center of the center hole 313. Similarly, a distance x' between the upper portion of the second cam groove 312 and the center of the center hole 313 should be shorter than the distance y' between the lower portion of the second cam groove 312 and the center of the center hole 313. Further, the distance x between the upper portion of the first cam groove 311 and the center of the center hole 313 should be longer than the distance y' between the lower portion of the second cam groove 312 and the center of the center hole 313.

As described above, and as shown in FIG. 6B, according to the rotational state of the rotary knob 310, the distances R1, R2, R3, and R4 between the rotary shaft 330 and the cam pin 213 can be expressed by the inequality, R1>R2>R3>R4.

According to the location of the cam pin 213 within the first cam groove 311, the photo sensor module 211 linearly reciprocates on a horizontal line Z between extremes indicated by R1 and R4. Accordingly, the moving distance of the photo sensor module 211 can be variably adjusted within a range that can be altered by varying the shape of the cam grooves 311 and 312 according to the size of the printing medium 1.

Meanwhile, according to another aspect of the present invention, there is provided a positioning device on the frame 110 and the rotary knob 310 for locking and unlocking the rotational movement of the rotary knob 310 by a complementary operation. This accordingly determines the moving position of the housings 212 and 222.

Figure 7:
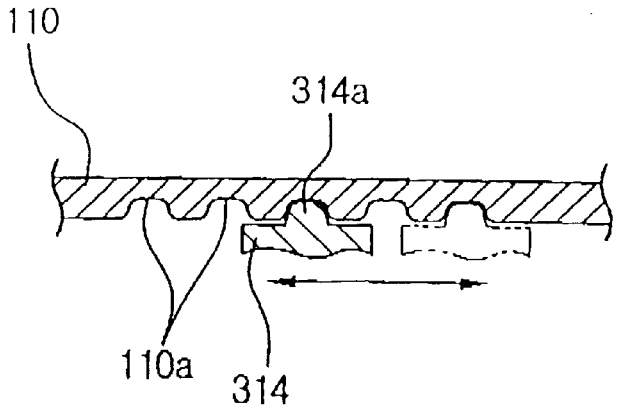
FIG. 7 is a fragmented sectional view taken on line I—I of FIG. 2 for showing the main portion of the present invention.

The rotary knob 310 includes an elastic rib 314 movably formed on the body of the rotary knob 310 and a tab protrusion 314*a* formed on the elastic rib 314. Further, as shown in FIG. 7, the rotary knob 310 also includes a plurality of tab grooves 110*a* formed on the frame 110 in a predetermined pattern in which the tab protrusion 314*a* is selectively seated and locked according to the rotational position of the rotary knob 310.

In one embodiment, a scale is marked on the frame 110 corresponding to the plurality of tab grooves 110*a*, respectively, and along the moving path of the driving lever 320, to thereby serve as a means of identifying the rotational movement of the rotary knob 310.

The operation of the detecting device of the printer for detecting termination of the printing medium constructed as described above according to the present invention will be further described in greater detail below.

Figure 8:
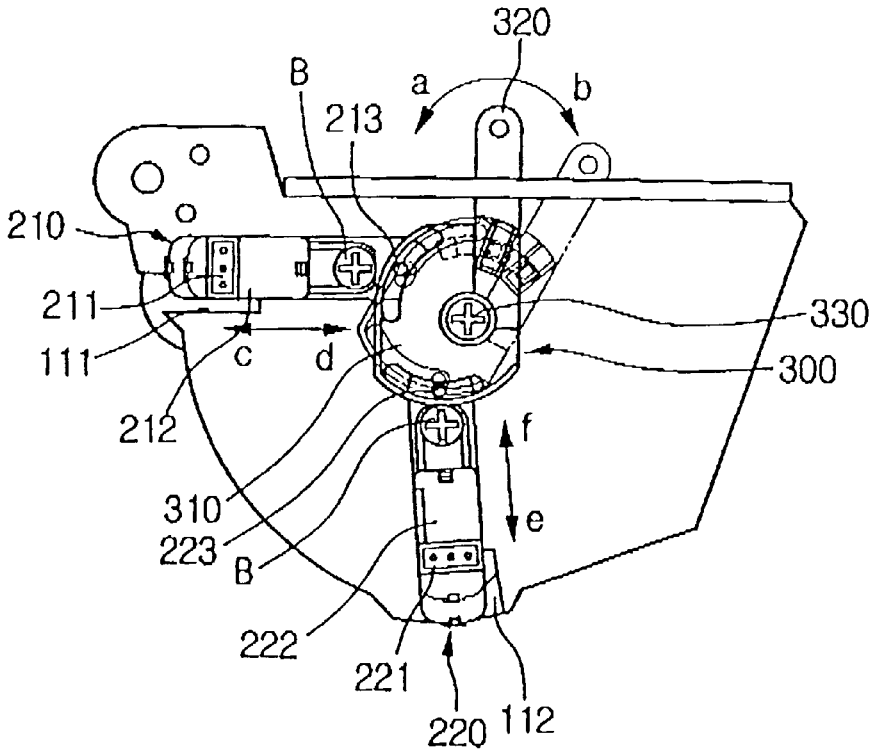
FIG. 8 is a schematic front elevation view for explaining the operation of the detecting device of the printer according to the present invention.

FIG. 8 shows the frame 110 in the first position, in which the frame 110 is positioned in a horizontal posture for use in a so-called desktop printer. As the printing medium 1 is continuously supplied, the diameter of the roll of the printing medium 1 is decreased, and accordingly, the roll of the printing medium 1 is guided along the guiding end 123 which is formed on the inner surface of the frame 110 toward the lower portion of the frame.

Figure 9A:
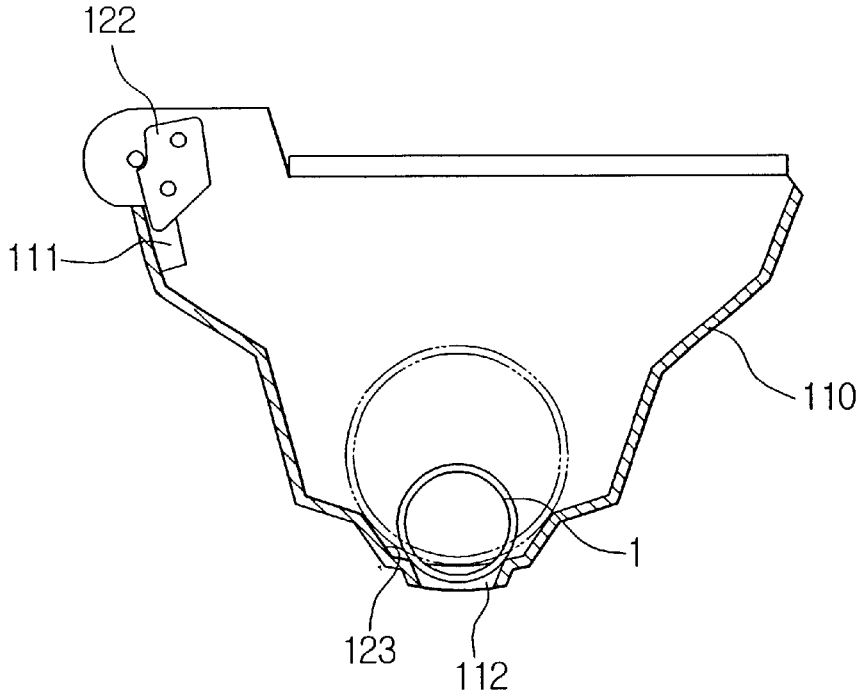
FIGS. 9A and 9B are schematic views for explaining the respective postures of the detecting device of the printer according to the present invention.

When the diameter of the roll of the printing medium 1 is decreased to a certain threshold where the roll of the printing medium 1 is positioned at the lowest portion of the frame 110, one end of the roll is exposed through the window 112 (see FIG. 9A).

At this time, the light emitted from the photo sensor module 221 is reflected back to the photo sensor module 221. In response, the main controller (not shown) outputs the results in the form of an electric signal. Accordingly, information indicating the termination or near-termination of the printing medium 1 is detected, and this information is conveyed to the user through a display or a certain form of an alarm. Thus, before the complete termination of the printing medium 1, the user can replace the roll of the printing medium 1 with a new one in a timely manner.

Figure 9B:
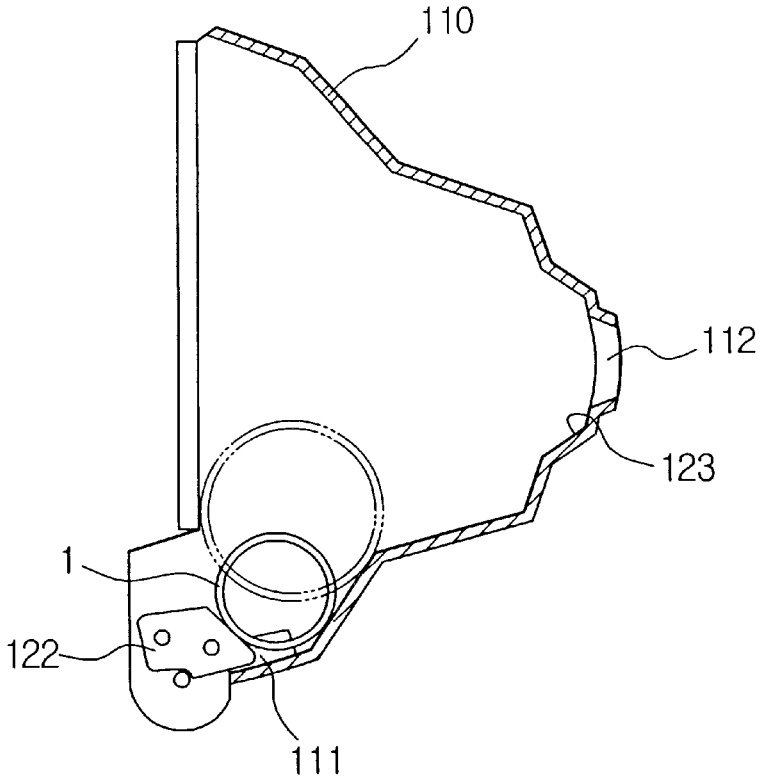

Further, when the frame 110 is positioned in the second position, i.e., when the frame 110 is positioned in the vertical position for use in a so-called wall mount printer, the termination or near-termination of the printing medium 1 can also be detected by the same operation as in the first position. That is, as shown in FIG. 9B, as the diameter of the roll of the printing medium 1 is decreased by the continuous supply of the printing medium 1, the roll of the printing medium 1 is downwardly guided by the guiding protrusions 121 and 122 and along the guiding end 123 formed on the inner surface of the frame 110 toward the lower portion of the frame 110.

When the diameter of the roll of the printing medium 1 is decreased to the maximum extent, and the roll thus positioned at the lowest portion of the frame 110, one end of the roll of the printing medium 1 is exposed through the window 111. At this time, the light emitted from the photo sensor module 211 is reflected and received by the photo sensor module 211, and, accordingly, the main controller (not shown) outputs the result in the form of electrical signal. In this manner, information indicating the termination or near-termination of the printing medium 1 is detected, and the information is conveyed to the user through a display or an audible alarm sound. Thus, before the printing medium 1 is completely terminated, the user can replace the old roll of the printing medium 1 with a new one in a timely manner.

Figure 10:
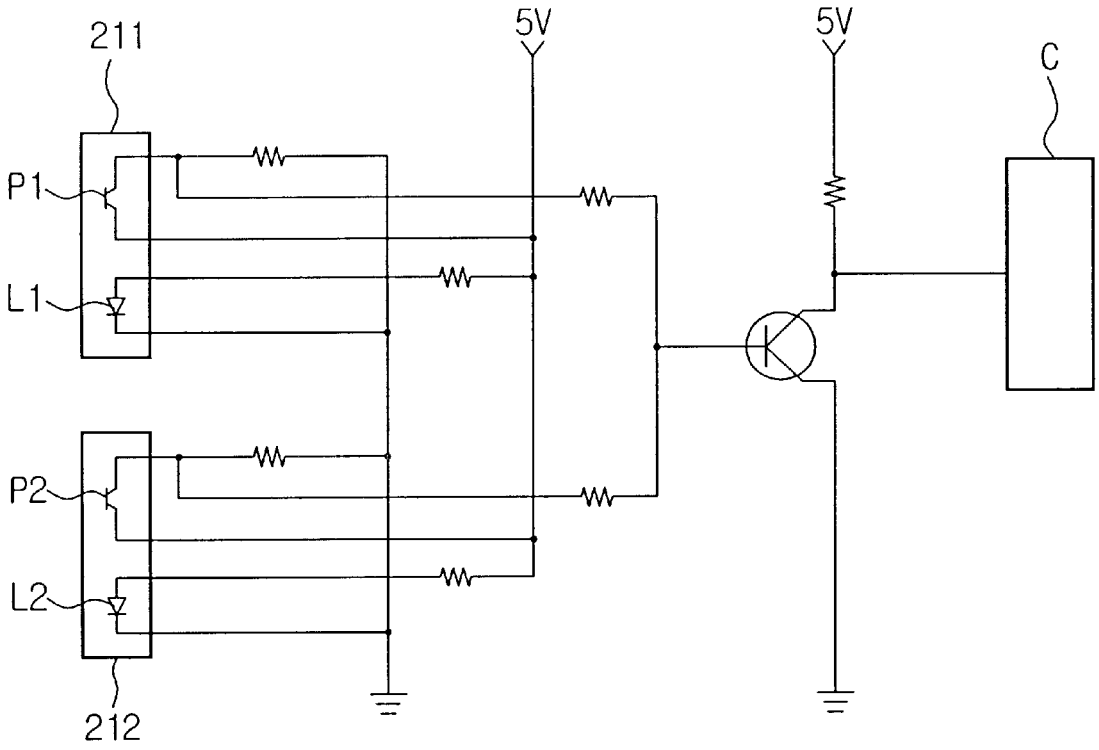
FIG. 10 is a circuit diagram showing the detecting device of the printer according to the present invention.

FIG. 10 shows a circuit structure for processing the signals from the photo sensor modules 211 and 221 and outputting the result to the controller C of the printer. As shown in FIG. 10, the photo sensor modules 211 and 221 each include light emitting diodes L1 and L2 for emitting light to the side of the roll of the printing medium 1 through windows 111 and 112, and photo transistors P1 and P2 for detecting light reflected back when the side of the printing medium 1 is visible through windows 111 and 112.

Thereby, according to the present invention, when the reflected light is received in any one of the photo transistors P1 and P2, a signal indicating a low-level of the printing medium 1, such as a zero volt (0V) signal, is input to the controller C. When reflected light is not detected by any of the photo transistors P1 and P2, a signal indicating a high-level of the printing medium 1, such as a five volt (5V) signal, is input to the controller C. When reflected light is received in the photo transistor P1 and/or photo transistor P2, the low-level signal is also input to the controller C.

Accordingly, when the printing medium 1 is near termination, the controller C detects the termination or near-termination of the printing medium 1 according to the low-level signal input regardless of the position of the roll of the printing medium 1, i.e., whether the roll of the printing medium 1 is located at the photo sensor module 211 or 221. Thus, the apparatus of the present invention detects the termination or near-termination of the printing medium 1 whether the frame 110 is in the first position or the second position, and the apparatus of the present invention continues to do so without adjustment when the frame 110 is switched between the first position and the second position.

Further, the apparatus of the present invention detects the termination or near-termination of the printing medium 1 without adjustment even when the size of the roll of the printing medium 1 mounted in the printer is varied according to the desires of the user for the usage of the printer. For example, the user may switch between a first unit roll (or core) of a predetermined outer diameter and a second unit roll (or core) of outer diameter smaller than the first unit roll (or core) without affecting the point of near-termination at which the roll of the printing medium 1 will drop to reflect the light back through the windows 111 and 112.

However, the detect position varies according to the inner diameter of the roll on which the printing medium mounted in the frame 110. Therfore, the setting position of the photo sensor modules 211 and 221 should be adjusted according to the size of the inner roll (or core) of the printing medium 1, in order to prevent occurrence of error in the information about the termination or near-termination of the printing medium 1.

When minute adjustment is required with respect to the detect points of the photo sensor modules 211 and 221, the detecting device according to the present invention accomplishes the adjustment with the positioning adjusting means 300.

More specifically, the position adjusting means 300 adjusts the initial set position of the photo sensor modules 211 and 221. As shown in FIG. 8, as the rotary lever 320 is rotated in direction a or b, the position adjusting means 300 moves the housing 212 in direction c or d according to the cam following movement of the first and the second cam grooves 311 and 312 and the cam pins 213 and 223. At the same time, the housing 222 is moved in a direction e or f. As a result, according to the diameter of the roll of the printing medium 1 in use, the detection points of the photo sensor modules 211 and 221 can be adjusted higher or lower within the windows 111 and 112, and the initial set position of the photo sensor modules 211 and 221 can be adjusted easily.

As described above, according to the detecting device of the printer for detecting termination of the printing medium of the present invention, the setting position and detection points can be variably adjusted by using the initial diameter of the roll of the printing medium 1, diameter of the roll of the near-terminated printing medium 1, and detection points of the photo sensor modules 211 and 221.

According to the present invention, due to the identifying switch which identifies and adjusts rotational movement of the rotary knob 310 during the adjustment of the detection points of the photo sensor modules 211 and 221, the moved location of the photo sensor modules 211 and 221 can be consistently identified and, accordingly, adjustments thereof easily made.

Further, when completing the setting of the detection points of the photo sensor modules 211 and 221 as intended, the tab protrusion 314*a* formed on the elastic rib 314 of the rotary knob 310 is selectively locked in one of the plurality of tab grooves 110*a* formed on the frame 110, and, in this manner, the setting position is firmly maintained.

When adjustment is required, in the detecting device of the printer for detecting termination of the printing medium according to the present invention, by pivoting the rotary lever 320 in direction a or b, the housing 212 is moved in direction c or d and the housing 222 is moved in direction e or f by the cam following movement of the first and the second cam grooves 311 and 312 and the cam pins 213 and 223. As a result, the detection points of the photo sensor modules 211 and 221 are adjusted higher or lower within the windows 111 and 112 according to the diameter of the roll of the printing medium 1 in use, and the initial set position of the photo sensor modules 211 and 221 can be adjusted easily.

As described above, according to the operational principle of the detecting device of the printer for detecting termination of the printing medium of the present invention, the setting position and detect points can be variably adjusted by using the initial diameter of the roll of the printing medium 1, diameter of the roll of the near-terminated printing medium 1, and detect points of the photo sensor modules 211 and 221.

According to the present invention, due to the identifying switch, which can identify and adjust rotational movement of the rotary knob 310 during the detection point adjustment of the photo sensor modules 211 and 221, the moved location of the photo sensor modules 211 and 221 can be consistently identified and, accordingly, adjustments thereof are easily made.

Further, when completing the setting of the detection points of the photo sensor modules 211 and 221 as intended, the tab protrusion 314*a* formed on the elastic rib 314 of the rotary knob 310 is selectively locked in one of the plurality of tab grooves 110*a* formed on the frame 110, and, in this manner, the setting position is firmly maintained.

As described above, the detecting device of the printer for detecting termination of the printing medium according to the present invention has an improved compatibility so that various sizes of the roll of the printing medium 1 can be used. Accordingly, operation ratio of the printer is improved.

Further, since changing the posture of the frame 110 does not require a separate setting or position adjustment for the detecting device, the user's convenience is also enhanced by the present invention.

Yet still further, since the aperture 217 of the housings 212 and 222 combines the light into a predetermined width, the detection accuracy is also enhanced.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. An apparatus of a printer for detecting a termination of a printing medium, comprising:

a frame, the frame housing and supporting a roll of the printing medium;

printing medium detecting means for non-contact detecting of the termination or a near-termination of the printing medium according to a varying diameter of the roll of the printing medium; and position adjusting means for adjusting an initial set position of the printing medium detecting means according to an initial diameter of the roll of the printing medium;

wherein the position adjusting means comprises:

a cam pin formed on a housing; and a rotary knob rotatably mounted on the frame, and having a cam groove for linearly reciprocating the housing in cooperation with the cam pin which is contained in the cam groove and movable along the cam groove.

2. The apparatus of a printer as claimed in claim 1, wherein the printing medium detecting means comprises:

a window in the frame and capable of passing light therethrough;

a photo sensor module for emitting light to the window, detecting light reflected back through the window, and outputting a result of said detecting in the form of an electrical signal; and a housing movably mounted on the frame for supporting the photo sensor module.

3. The apparatus of a printer as claimed in claim 1, further comprising a positioning device provided to the frame and the rotary knob, for locking and unlocking a rotational movement of the rotary knob by a predetermined unit, and identifying a moved location of the housing.

4. The apparatus of a printer as claimed in claim 3, wherein the positioning device comprises:

a tab protrusion formed on an elastic rib which is movably formed on the rotary knob; and a plurality of tab grooves formed on the frame in a predetermined pattern, to which the tab protrusion is selectively seated according to the rotational movement of the rotary knob.

5. The apparatus of a printer as claimed in claim 1, wherein the frame has a guiding portion stepped on an inner surface of the frame, the guiding portion guiding the roll of the printing medium to a lower portion of the frame when the diameter of the printing medium decreases below a predetermined threshold defining the near-termination of the printing medium.

6. An apparatus of a printer for detecting a termination of a printing medium, comprising:

a frame, the frame housing and supporting a roll of the printing medium and having a first position and a second position;

first printing medium detecting means and second printing medium detecting means for non-contact detecting of the termination or a near-termination of the printing medium according to a varying diameter of the roll of the printing medium when the frame is in the first position or the second position; and position adjusting means for adjusting an initial set position of the first and the second printing medium detecting means according to an initial diameter of the roll of the printing medium.

7. The apparatus of a printer as claimed in claim 6, wherein an angle between the first and the second positions of the frame is 90°, and the frame is selectively turned to the first position and the second position.

8. The apparatus of a printer as claimed in claim 6, wherein the frame is arranged in a horizontal plane in the first position and in a vertical plane in the second position, and the frame is selectively turned to the first position and the second position.

9. The apparatus of a printer as claimed in claim 6, wherein the frame has guiding means formed on an inner surface of the frame, the guiding means guiding the roll of the printing medium to a lower portion of the frame in the first and the second positions when the diameter of the printing medium decreases below a predetermined threshold defining the near-termination of the printing medium.

10. The apparatus of a printer as claimed in claim 6, wherein the first and the second printing medium detecting means comprise:

a pair of windows in the frame at said lower portions in the first and second positions, the pair of windows capable of passing light therethrough;

a pair of photo sensor modules for emitting light to the windows, detecting light reflected back through the windows, and outputting a result of said detecting in the form of an electrical signal; and a pair of housings movably mounted on the frame for supporting the photo sensor modules.

11. The apparatus of a printer as claimed in claim 10, wherein the pair of housings have an aperture through which the light from the photo sensor modules is passed in a limited width.

12. The apparatus of a printer as claimed in claim 11, wherein the aperture has a width in a range from 30% to 50% of a diameter of a light spot emitted from the photo sensor modules.

13. The apparatus of a printer as claimed in claim 10, wherein the housings have a shutter member slidably mounted on an aperture for adjusting a width of the aperture and thereby adjusting a size of a light spot of light passed through the aperture.

14. The apparatus of a printer as claimed in claim 6, wherein the position adjusting means comprises:

a housing;

a first cam pin and a second cam pin formed on the housing; and a rotary knob rotatably mounted on the frame, and having a first cam groove and a second cam groove for linearly reciprocating the housing in cooperation with the first cam pin and the second cam pin which are contained in the first and the second cam grooves and movable along the first and the second cam grooves.

15. The apparatus of a printer as claimed in claim 14, wherein a distance between a rotational shaft of the rotary knob and an end of the first cam groove is longer than a distance between the rotational shaft of the rotary knob and an end of the second cam groove opposing the end of the first cam groove.

16. The apparatus of a printer as claimed in claim 14, further comprising a positioning device provided to the frame and the rotary knob, for locking and unlocking a rotational movement of the rotary knob by a predetermined unit, and identifying a moved location of the housings.

17. The apparatus of a printer as claimed in claim 16, wherein the positioning device comprises:

a tab protrusion formed on an elastic rib which is movably formed on the rotary knob; and a plurality of tab grooves formed on the frame in a predetermined pattern, to which the tab protrusion is selectively seated according to the rotational movement of the rotary knob.

18. The apparatus of a printer as claimed in claim 6, wherein the first and the second printing medium detecting means indicate the termination or near-termination of the printing medium when any one of the first and the second printing medium detecting means detects the termination or near-termination of the printing medium.

* * * * *